US005534045A

United States Patent [19]

Ogura et al.

[11] Patent Number: 5,534,045

[45] Date of Patent: Jul. 9, 1996

[54] WATER-ATOMIZED IRON POWDER AND METHOD

[75] Inventors: Kuniaki Ogura; Hiroyuki Ishikawa; Yoshiaki Maeda; Kouichi Komamura, all of Chiba, Japan

[73] Assignee: Kawasaki Steel Corporation, Japan

[21] Appl. No.: 440,913

[22] Filed: May 15, 1995

Related U.S. Application Data

[63] Continuation of Ser. No. 243,997, May 18, 1994, Pat. No. 5,462,577.

[30] Foreign Application Priority Data

| | | | |
|---|---|---|---|
| May 18, 1993 | [JP] | Japan | 5-115523 |
| Aug. 6, 1993 | [JP] | Japan | 5-196170 |
| Oct. 14, 1993 | [JP] | Japan | 5-256807 |

[51] Int. Cl.[6] ..... C22C 29/00

[52] U.S. Cl. ..... 75/243; 75/255

[58] Field of Search ..... 75/345, 255, 343, 75/243

[56] References Cited

U.S. PATENT DOCUMENTS

| | | | |
|---|---|---|---|
| 4,209,320 | 6/1980 | Kajinaga et al. | 75/255 |
| 5,067,979 | 11/1991 | Kiyota et al. | 75/243 |
| 5,328,500 | 7/1994 | Beltz et al. | 75/343 |
| 5,462,577 | 10/1995 | Ogura et al. | 75/345 |

*Primary Examiner*—Scott Kastler
*Attorney, Agent, or Firm*—Austin R. Miller

[57] ABSTRACT

Water-atomized iron powder for powder metallurgy having a hardness of particle cross section of from about Hv 80 or higher to about 250 or lower, the iron powder having been atomized with water and dried, and having a particle surface covered with oxides which are reducible in a sintering atmosphere, and which has an oxygen content of 1.0 wt % or less.

The water-atomized ion powder can be made by an improved and simplified processing, and the cost of resulting sintered products is decreased as a result of its use.

5 Claims, 1 Drawing Sheet

WATER-ATOMIZED IRON POWDER AND METHOD

This application is a continuation of application Ser. No. 08/243,997, filed on May 18, 1994, now U.S. Pat. No. 5,462,577.

BACKGROUND OF THE INVENTION

1. Field of the Invention

The present invention relates to an iron powder useful in water-atomized powder metallurgy, and further relates to a method of manufacturing the iron powder.

2. Description of the Related Art

In general, water-atomized iron powder is made by atomizing molten steel with high pressure water. This is often followed by annealing, softening and reducing, removing oxide film from particle surfaces, and crushing. Performance of all of these steps is considered necessary. Thus, the possibility of cost reduction by eliminating processing steps is limited.

When sintered parts are made of iron powder, it is necessary to compact the iron powder with addition of lubricant and additive alloy component powders, followed by sintering the resulting green compact at a high temperature and further sizing for dimensional adjustment. Accordingly, the cost of the entire process is further increased.

Cost reduction is important. Every effort must be made to reduce manufacturing costs of, for example, automobile parts. For that purpose substantial efforts have been made.

However, omissions of any process steps, in particular, omission of annealing, softening and reducing steps has not been achieved because the water-atomized iron powder is solid due to its quenched structure and is difficult to compact. Further, although a considerable amount of oxygen is introduced into the iron powder as a sintering material, oxygen is generally considered harmful to sintered parts.

For example, although Japanese Patent Unexamined Publication No. Sho. 51-20760 discloses a method of manufacturing iron powder in which molten steel is produced in a converter and vacuum decarbonization apparatus, this method includes annealing and reducing powder atomized with water and drying.

Further, Japanese Patent Examined Publication No. Sho 56-45963 discloses a method of improving the characteristics of iron powder by mixing a finished powder that has been subjected to annealing and reducing with an atomized raw iron powder that was not subjected to annealing or reducing. Although it is desired to use atomizod raw iron powder not subjected to annealing or reducing, predetermined characteristics cannot be achieved by that powder alone.

Further, although Japanese Patent Unexamined Publication No. Sho 63-157804 discloses a process for manufacturing atomizod iron powder by suppressing oxidization and carburizing as much as possible by the addition of alcohol etc. to the atomizing water, the resulting iron powder contains 0.01% or more of C and is easily hardened an the cooling speed achieved by atomizod water, although it contains a small amount of oxygen. The resulting iron powder cannot be compacted in dies and requires further annealing and softening.

On the other hand, it is necessary to minimize dimensional changes caused in the manufacturing process.

In particular, since the achievement of dimensional accuracy without depending upon sizing leads to the omission of process steps and accordingly to cost reduction, efforts have been made along those lines.

For example, Japanese Patent Examined Publication No. Sho 56-12304 discloses and proposes a technology for improving dimensional accuracy by particle size distribution and Japanese Patent Unexamined Publication No. Hei 3-142342 discloses and proposes technology for predicting and controlling the dimensional change in sintering according to powder configuration.

Although iron powder for powder metallurgy contains added lubricant etc. in addition to Cu powder and graphite powder, since the iron powder is moved or transported to replace the container in which it is contained, the added Cu powder and graphite powder tend to segregate, so that the components of the powder are easily dispersed. Consequently, dimensional changes caused in sintering are likely to happen, and a subsequent sizing process is conventionally indispensable.

Taking the aforesaid defects of the prior art into consideration, an important object of the invention is to provide technology for producing at low cost iron powder that is suitable for sintering. Another object of the invention is to reduce manufacturing costs of iron powder while retaining compactibility (formability). Further, another object of the invention is to lower manufacturing costs of powder as well as to manufacture an iron powder for use in powder metallurgy having stable dimensional changes in sintering, and in particular having limited dimensional dispersion with respect to the dispersion of graphite.

SUMMARY OF THE INVENTION

The present invention relates to water-atomized iron powder for use in powder metallurgy which has a particle cross section hardness of about Hv 80 or higher to about 250 or lower when the iron powder is atomized with water and dried, further has a particle surface covered with oxides which are reducible in a sintering atmosphere, and further has an oxygen content of about 1.0 wt % or less.

In the iron powder of this invention, those particles having a particle size of from about 75 μm or more to less than about 106 μm, include a portion having a coefficient of particle cross-sectional configuration of about 2.5 or less and comprising in a numerical amount of about 10% or more, and the iron powder further contains particles having a particle size of about 45 μm or less in an amount about 20 wt % or more.

In the foregoing, the coefficient of particle cross-sectional configuration of a particle is defined as a value obtained by dividing the square of the circumferential length of a particle cross section by $4\pi$ times the cross-sectional area of the particle and is obtained by the steps mentioned below.

Step 1: Sieve iron powder and obtain particles having a diameter 75 μm–106 μm.

Step 2: Bury thus obtained particles into resin.

Step 3: Cut and polish thus obtained resin in an arbitrary section with iron particles and observe cross sectional configuration of iron particles using a micro-scope.

Step 4: Analyze 500–1000 particles concerning cross-sectional configuration of particles using an image analyzer and obtain a coefficient for each of said particles.

Further, water-atomized iron powder according to this invention contains elements that are more easily oxidizable than iron in an amount of 0.003 to 0.5 wt %, and has a particle surface covered with oxides which are unreducible in a sintering atmosphere.

This invention further relates to a method of manufacturing the iron powder covered with such oxides.

Other features of the present invention will be apparent from the accompanying detailed description and from the drawings.

DESCRIPTION OF THE PREFERRED EMBODIMENT

Figure 1:
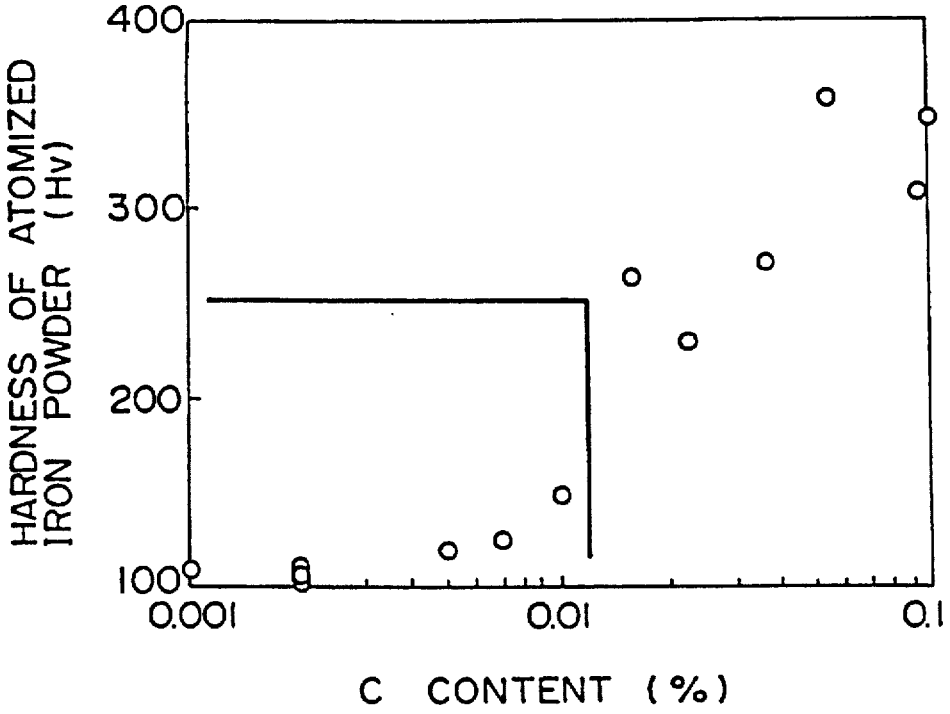
FIG. 1 is a chart which shows a relationship between hardness of atomized raw iron powder and the amount of C contained in the iron powder.

It has now been discovered that softening, annealing and reducing process steps can be eliminated under specified conditions.

Softening, annealing and reducing have been used to soften by annealing the hardened structure of the iron powder produced by atomizing with water. Raw iron powder in the water-atomized state has high hardness and is inferior in formability (compactibility) and cannot be used for powder metallurgy in that state.

The term "compactibility" refers to the green density obtained when iron powder is molded and pressed under the prevailing compacting pressure, and serves as an index for evaluating the characteristics of the green compact which is often used in powder metallurgy. When the compactibility index has a larger value, the green compact has better characteristics. Further, when iron powder is water-atomized, the iron powder particles tend to be covered with oxide films such as FeO, etc. These films interfere with formability of the iron powder and lower the strength of the sintered body. Thus, the oxide films have ordinarily been removed by softening, annealing and reducing.

The term "formability" as used herein relates to the strength of the green compact and may be represented by a "rattler value" which serves as an index for evaluating the characteristics of the green compact. A lower rattler value is preferable to a higher one.

According to this invention, water-atomized iron powder can remarkably be made with satisfactory compactibility, formability and sintering properties without the expense and burden of softening, annealing and reducing process steps.

It has been discovered that good compactibility can be achieved in atomized raw iron powder when the hardness of the particles is decreased to a Vickers hardness Hv value of about 80 to about 250.

As an example, one raw powder composed of C: 0.007 wt %, Mn: 0.005 wt %, Ni: 0.03 wt %, Cr: 0.017 wt %, Si: 0.008 wt %, P: 0.003 wt %, S: 0.002 wt % and the balance of substantial Fe had a low Vickers hardness Hv (100) of 107. When this powder was added and mixed with 1.0 wt % of zinc stearate and then compacted in metal dies at a compacting pressure of 5 t/cm$^2$, an excellent green density of 6.81 g/cm$^3$ was obtained and both the hardness of particle cross sections and the green density had excellent values similar to those of comparable prior art iron powders which had been subjected to softening, annealing and reducing.

We have carefully examined the relationship between hardness and compactibility and have found that a green compact having advantageous green density can be obtained when the particle cross section of the iron powder had a Vickers hardness of about Hv 250. The lower the hardness of the particle cross section, the better its compactibility. It is not practical industrially to achieve a hardness less than about Hv 80 because the refining cost of the molten metal tends to be uselessly increased.

Therefore, the Vickers hardness of the particle cross section of the iron powder according to the present invention is maintained within the range of about Hv 80–250.

Such a particle cross section hardness can be obtained by reducing the amounts of harmful components such as C etc. as much as possible. As is shown in FIG. 1 of the drawings, when the amount of C is reduced the hardness of the iron powder is also reduced and approaches or betters the hardness of other finished iron powder that has been reduced and annealed.

When iron powder contains C in an amount of about 0.01 wt % or less, no significant hardening occurs even if the iron powder is atomized with water. When the content of C exceeds about 0.01 wt %, however, the powder hardness is increased. The C content is accordingly about 0.01 wt %, preferably about 0.005 wt % or less.

Mn, Ni and Cr greatly influence compactibility. As examples, various iron powders containing C in the range of about 0.01 wt % or less were atomized with water and dried, while the contents of Mn, Ni and Cr in the powders were changed through the range of about 0.40 wt % to none. When the content of Mn, Ni and Cr exceeded about 0.30 wt %, the hardness Hv (100) of the raw iron powder exceeded 250 and the iron powder was difficult to compact under pressure in metal dies. Further, sufficient green density could not be obtained. According to this invention the content of Mn, Ni and Cr should be about 0.30 wt % or less. The contents of these elements are preferably even about 0.1 wt % or less, but when they are excessively lowered, steelmaking cost is increased.

The total content of P and S should be about 0.05% or less. Although it is preferable to reduce the content of P and S as much as possible, when the total content is about 0.05% or less, no adverse hardness affect is caused.

The existence of oxygen (O) has been conventionally severely restricted; indeed O has been removed by reduction. We have discovered, however, that the presence of O is harmless to the sintering process if its content is within the parameters of this invention and if the percentage of O does not exceed a specific range. More particularly, unless the content of O exceeds about 1.0 wt %, the compactibility and formability of iron powder are satisfactory. In this case, O generally exists in combination with Fe, and when its content is within the above range, FeO is reduced to Fe in the reducing atmosphere that exists in the sintering process. Thus, the existence of O in the above range is surprisingly found to be permissible. While the O content can be any value below about 1.0 wt %, it is preferable from the viewpoint of formability to control the content of O as oxide reduced in the sintering process to about 0.5 wt % or less.

According to the present invention, Mo and/or Nb are further added in a preferable amount because these elements contribute to improvement of compactibility. Mo in a range of about 0.05 wt % to about 5.0 wt % improves compactibility and further promotes sintering and improves the strength of the sintered body. When the content of Mo exceeds about 5.0 wt %, compactibility is abruptly lowered.

Nb added in the range from about 0.005 wt % to about 0.2 wt % improves compactibility. When it is added in an amount exceeding about 0.2 wt %, however, compactibility is abruptly lowered.

Although the present invention successfully provides satisfactory iron powder for sintering, depending upon the hardness of the particles of the iron powder and a predetermined amount of oxygen contained therein, the iron powder in an atomized state has a hardness greater than that (Hv: 80–120) of generally used iron powder which has been subjected to annealing, softening and reducing. This is because of the creation of a partially hardened structure and the introduction of strain due to quenching. Therefore, it is preferable to consider and control the configuration of the iron powder particles in order to obtain good compactibility.

According to the present invention, particle configuration is represented in terms of a coefficient of particle configuration. The coefficient of particle configuration is represented by a value obtained by dividing the square of the circumference of the particle cross section by $4\pi$ times the cross-sectional area of the particle. This value is 1 when the cross section of the particle is a perfect circle.

We have found that when particles having a coefficient of particle cross-sectional configuration of about 2.5 or less are present in an amount of about 10% or more by weight in those relatively coarse particles which have a particle size of from about 75 μm or more to less than about 106 μm, even if the cross section of the particles has a hardness exceeding about Hv 200, a green density of about 6.70 g/cm$^3$ or more can be obtained at a compacting pressure of 5 t/cm$^2$ when the powder is mixed with a 1 wt % of solid lubricant. This fact is highly important and advantageous.

It is important to consider those relatively coarse particles having a particle size of from about 75 μm to about 106 μm. The relatively coarse particles having a particle size of about 75 μm or more greatly contribute to compactibility and have the heaviest weight when screened in normal powder metallurgy.

On the other hand, when a particle configuration is rounded, the resulting sintered body strength tends generally to be decreased. This problem can be solved by the existence in those relatively coarse particles of about 20% or more of relatively fine powder particles having a size of less than about 325 mesh, which particles are about 45 μm or less in size.

A tensile strength of about 25 kgf/mm$^2$ or more can be obtained in a sintered body having a sintered density of 6.8 g/cm$^3$ which is obtained, for example, in such a manner that 2.0 wt % of Cu and 0.8 wt % of graphite and solid lubricant are mixed with Fe powder and compacted and then sintered at 1130° C. for 20 minutes in a $N_2$ atmosphere. However, when particles of −325 mesh (45 μm or less) exceed 50 wt %, compactibility is undesirably reduced.

As described above, the green density and sintered body strength of the raw powder of the present invention can be controlled in accordance with the configurations of those particles which have particle sizes of from about 75 μm or more to less than about 106 μm, and by considering the amount of particles having sizes of about 45 μm or less (−325 mesh). Such particle configurations and particle size distributions can be obtained when the atomizing water has a jet pressure in a range of from about 40 kgf/cm$^2$ or higher to about 200 kgf/cm$^2$ or lower, and when the water-to-molten-metal ratio is in the range of from about 5 to 15.

The raw powder after having been atomized with water is preferably dried at about 100° to 200° C. in a non-oxidizing atmosphere, as is usual. It is not necessary to soften, anneal or reduce the raw powder which is highly advantageous.

It is important to observe that when a sintered body is made of iron powder, its dimensional accuracy must be improved. We have found that the dimensional accuracy of sintered products can be greatly improved by the existence of specified amounts of oxides, not reduced in the sintering process, on the surfaces of the particles.

More specifically, we have discovered that the creation of FeO by oxidization in the atomizing process can be suppressed by the addition of other elements that more easily oxidizable than iron, such as Si, Al, V, Ti, Zr. These are hereinafter referred to for convenience as easy-to-oxidize elements. Iron powder having an unusual surface structure covered with oxides of the easy-to-oxidize elements can be obtained. We believe the easy-to-oxidize elements in the iron are selectively oxidized so that oxide films are formed on the surface of the iron powder and serve as protective films.

Although the reason why dimensional accuracy can be improved by the existence of the oxides of the easy-to-oxidize elements on the surface of iron powder is not yet clarified, we believe that the diffusion of carbon from graphite added in the sintering process into the particles of the iron powder is suppressed. Thus, the amount of C invading and diffusing into the iron powder is kept substantially at a specific level regardless of changes of the amount of added graphite or changes of its particle size. As a result, the amount of so-called expansion due to Cu is also stabilized.

With this arrangement, the dispersion of dimensional changes of a Fe-Cu-C system which is sensitive to the dispersion of graphite can be suppressed to a low level.

The amount of oxygen in the form of FeO on the powder is simultaneously reduced by the addition of the easy-to-oxidize elements, whereby the formability of the iron powder is further improved.

Figure 2:
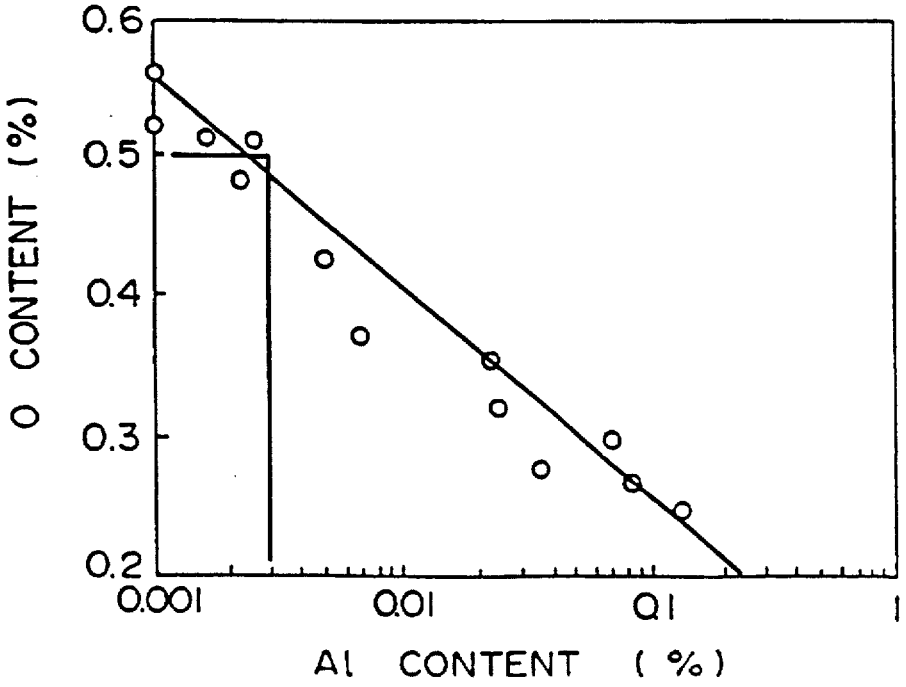
FIG. 2 is another chart which shows a relationship between an amount of oxygen and the amount of Al, each in the iron powder.

FIG. 2 of the drawings shows a typical relationship between the amount of Al dissolved in the molten steel and the content of O in a water-atomized raw iron powder.

The easy-to-oxidize elements in accordance with this invention include Si, Al, V, Ti and Zr. They may be present or added independently or as a mixture. Preferable ranges of addition are as follows: Si: about 0.01-about 0.1 wt %, Al: about 0.003-about 0.05 wt %, V: about 0.008-about 0.5 wt %, Ti: about 0.003-about 0.1 wt %, Zr: about 0.008-about 0.1 wt %.

The content of the easy-to-oxidize elements is better to be from about 0.003 wt % or more to about 0.5 wt %. When this amount is less than about 0.003 wt %, there is substantially no reduction of oxygen content, whereas an amount exceeding about 0.5 wt % tends to increase the content of oxygen, and resulting sintered body strength is abruptly decreased.

It is important to observe that to achieve improvement of dimensional accuracy of the product, the easy-to-oxidize elements must have an oxidizing ratio of about 20 wt % or more. When the oxidizing ratio is less than about 20 wt % there is less reduction of the variable range of dimensional changes in sintering with respect to the dispersion of added graphite. Even in this case, however, the oxygen content in the iron powder is limited to about 1% and preferably to about 0.5% or less, for the purpose of maintaining formability.

In order for the easy-to-oxidize element (Si, Al, V, Ti, Zr) to be added to molten steel to thereby create suitable oxide films on the surface of iron powder, the iron powder is atomized with water in a non-oxidizing gas atmosphere containing oxygen ($O_2$) with a concentration of about 5.0 vol % or less and dried in hydrogen, nitrogen or vacuum.

EXAMPLES

Example 1

Molten metal containing C: 0.002 wt %, Mn: 0.002 wt %, Ni: 0.006 wt %, Cr: 0.013 wt %, Si: 0.005 wt %, P: 0.002 wt %, S: 0.002 wt % was prepared in such a manner that molten steel was refined in a converter and decarbonized by the use of a vacuum decarbonizing apparatus. This molten metal was atomized with water at a water pressure of 75 kgf/cm$^2$ and a water-to-molten-steel ratio of 10. The resulting powder was dried at 125° C. in an atmosphere of $N_2$ and then screened to 1000 μm or less without being annealed and reduced.

The hardness of the powder was determined by measuring the cross section of the powder in terms of Vickers hardness with a load of 100 g. The coefficient of cross-sectional configuration of the particles was measured by means of an image processing apparatus. Green density was measured in such a manner that 1.0 wt % of zinc stearate was added to and mixed with raw powder and a tablet having a diameter of 11.3 mmϕ was compacted at a pressure of 5 t/cm$^2$. Sintered body strength was determined by measuring tensile strength of Fe-2.0 Cu-0.8 composition with a sintered density of 6.80 Mg/m$^3$ which was obtained in such a manner that a mixed powder of raw iron powder, Cu powder, graphite powder and solid lubricant was compacted and then sintered at 1130° C. in an endothermic gas (propane converted gas) atmosphere for 20 minutes.

Comparative Example 1 was obtained by subjecting commercially available water-atomized iron powder for sintering which had been reduced and annealed to the same process as the aforesaid. Table 1-1 shows chemical composition of the iron powders and Table 1-2 shows powder hardness, sintered body strength and the like.

Example 1 can obtain the powder hardness, green density and sintered body characteristics which are substantially the same as those of the conventional iron powder of Comparative Example 1 even without annealing or reducing.

TABLE 1-1

| | Chemical composition of raw powder (wt %) | | | | | | | |
|---|---|---|---|---|---|---|---|---|
| | C | Mn | Ni | Cr | Si | P | S | O |
| Example 1 | 0.002 | 0.002 | 0.006 | 0.013 | 0.005 | 0.002 | 0.002 | 0.53 |
| Comparative example 1 | 0.001 | 0.11 | 0.013 | 0.008 | 0.01 | 0.014 | 0.008 | 0.09 |

Examples 2–11, Comparative Examples 2–9

After having been refined in a converter or an electric furnace, molten metal containing C: 0.002–0.04 wt %, Mn: 0.4 wt % or less, Ni: 0.4 wt % or less, Cr: 0.4 wt % or less, Si: 0.005–0.03 wt %, P: 0.002–0.025 wt %, S: 0.002–0.03 wt % was prepared by use of a vacuum degassing apparatus. The molten metal was atomizod with water under a water pressure of 30–250 kgf/cm$^2$ and with a water to molten steel ratio of 10. The thus obtained powder was dried at 125° C. in an $N_2$ atmosphere, except in Comparative Example 7. Comparative Example 7 was dried at 125° C. in the atmosphere. These raw powders were screened to 1000 μm or less without being annealed or reduced.

Particle hardness, coefficient of particle cross-sectional configurations of the raw powders, green density and sintered body strength were measured using the same methods as Example 1.

Table 2-1 shows chemical composition of raw iron powders of Examples 2–11 and Comparative Examples 2–9. Table 2-2 shows powder hardness, atomized water pressure, ratio of particles having a coefficient of configuration of 2.5 or less in the particles having a particle size of 75–106 μm, ratio of particles having a size of –325# (45 μm or less), green density not subjected to a finishing reduction, and sintered body strength.

Although any of Examples 2–11 exhibits a practically applicable green density and sintered body strength, Comparative Examples 2–7 have the composition of raw powders which exceeds a proper range. Thus, the hardness of particles is Hv (100) 250 or higher and a green density of 6.70 Mg/m$^3$ or more cannot be obtained at a compacting pressure of 5 t/cm$^2$. Since Comparative Example 8 has an atomizing pressure exceeding a proper range, the ratio of the particles having a coefficient of configuration of 2.5 or less is 10% or less in the particles having a particle size of 75–106 μm. Thus, a green density of 6.70 Mg/m$^3$ or more cannot be obtained at a compacting pressure of 5 t/cm$^2$. Since Comparative Example 9 has an atomizing pressure exceeding a proper range, particles of –325# are 20% or less and thus a sintered body strength of 300 MPa cannot not be obtained at a sintered body density of 6.80 Mg/m$^3$.

TABLE 2-1

| | Chemical composition of raw powder (wt %) | | | | | | | |
|---|---|---|---|---|---|---|---|---|
| | C | Mn | Ni | Cr | Si | P | S | O |
| Example 2 | 0.002 | 0.001 | 0.005 | 0.001 | 0.005 | 0.001 | 0.002 | 0.61 |
| Example 3 | 0.006 | 0.005 | 0.011 | 0.01 | 0.010 | 0.005 | 0.002 | 0.45 |
| Example 4 | 0.010 | 0.01 | 0.011 | 0.02 | 0.018 | 0.006 | 0.009 | 0.47 |
| Example 5 | 0.010 | 0.012 | 0.013 | 0.025 | 0.020 | 0.006 | 0.008 | 0.45 |
| Example 6 | 0.006 | 0.29 | 0.005 | 0.001 | 0.005 | 0.002 | 0.002 | 0.65 |
| Example 7 | 0.006 | 0.05 | 0.29 | 0.002 | 0.007 | 0.001 | 0.003 | 0.52 |

TABLE 1-2

| | Powder hardness (Hv(100)) | Pressure of atomizing water (kgf/cm2) | Number % of Particles having coefficient of configuration of 2.5 or less (Particles size 75~106 μm) | wt % of Particle through 325 mesh (–45 μm) | Green density compacted at 5t/cm2 (Mg/m3) | Sintered body strength Sintered body density 6.8 Mg/m3 (MPa) |
|---|---|---|---|---|---|---|
| Example 1 | 102 | 75 | 35 | 27 | 6.93 | 370 |
| Comparative example 1 | 100 | — | — | 21 | 6.94 | 370 |

TABLE 2-1-continued

| | Chemical composition of raw powder (wt %) | | | | | | | |
|---|---|---|---|---|---|---|---|---|
| | C | Mn | Ni | Cr | Si | P | S | O |
| Example 8 | 0.007 | 0.006 | 0.004 | 0.3 | 0.006 | 0.004 | 0.002 | 0.62 |
| Example 9 | 0.005 | 0.004 | 0.004 | 0.003 | 0.005 | 0.015 | 0.019 | 0.51 |
| Example 10 | 0.004 | 0.004 | 0.005 | 0.004 | 0.005 | 0.002 | 0.002 | 0.55 |
| Example 11 | 0.004 | 0.003 | 0.005 | 0.003 | 0.005 | 0.003 | 0.003 | 0.55 |
| Example 12 | 0.005 | 0.004 | 0.003 | 0.002 | 0.006 | 0.004 | 0.004 | 0.55 |
| Comparative Example 2 | 0.032 | 0.01 | 0.013 | 0.2 | 0.029 | 0.007 | 0.011 | 0.41 |
| Comparative Example 3 | 0.005 | 0.38 | 0.003 | 0.004 | 0.005 | 0.002 | 0.002 | 0.7 |
| Comparative Example 4 | 0.004 | 0.004 | 0.41 | 0.003 | 0.005 | 0.002 | 0.003 | 0.53 |
| Comparative Example 5 | 0.004 | 0.003 | 0.003 | 0.42 | 0.005 | 0.002 | 0.002 | 0.68 |
| Comparative Example 6 | 0.003 | 0.003 | 0.004 | 0.004 | 0.008 | 0.025 | 0.030 | 0.51 |
| Comparative Example 7 | 0.003 | 0.002 | 0.002 | 0.003 | 0.003 | 0.002 | 0.004 | 1.2 |
| Comparative Example 8 | 0.003 | 0.003 | 0.004 | 0.004 | 0.008 | 0.005 | 0.005 | 0.65 |
| Comparative Example 9 | 0.003 | 0.003 | 0.004 | 0.004 | 0.008 | 0.005 | 0.005 | 0.6 |

19 was dried at 125° C. in the atmosphere. These raw powders were screened to 1000 μm or less without being annealed or reduced.

Particle hardness, coefficient of particle cross-sectional configuration of the raw powders, green density and sintered body strength were measured by the same methods as Example 1. Table 3-1 shows chemical composition of the raw iron powders of Examples 12–24 and Comparative Examples 10–19, and Table 3-2 shows powder hardness, atomized water pressure, ratio of the particles having a coefficient of configuration of 2.5 or less in the particles having a particle size of 75–106 μm, ratio of particles having a size of −325# (45 μm or less), green density, and sintered body strength of these examples and comparative examples.

Although Examples 12–24 exhibit a practically applicable green density and sintered body strength, Comparative Examples 10–16 have compositions of raw powders which exceed a proper range. Thus, the hardness of the particles is 250 or more and the green density of 6.70 Mg/m$^3$ or more cannot be obtained at a compacting pressure of 5 t/cm$^2$. Since Comparative Example 17 has an atomizing pressure exceeding a proper range, the ratio of the particles having a coefficient of configuration of 2.5 or less is 10% or less in the particles having a particle size of 75–106 μm. Thus, a green density of 6.70 Mg/m$^3$ or more cannot be obtained at a compacting pressure of 5 t/cm$^2$. Since Comparative Example 18 has an atomizing pressure exceeding a proper range, the particles of −325 mesh are 20% or less and thus a sintered body strength of 300 MPa cannot not be obtained at a sintered body density of 6.80 Mg/m$^3$. Comparative Example 19 has an amount of oxygen in the raw powder which exceeds a proper range because it is dried under improper drying conditions. Thus, a green density of 6.70 Mg/m$^3$, or more or a sintered body strength of 300 MPa, cannot be obtained.

TABLE 2-2

| | Powder hardness (Hv(100)) | Pressure of atomizing water (kgf/cm2) | Number % of Particles having coefficient of configuration of 2.5 or less (Particles size 75~106 μm) | wt % of Particle through 325 mesh (−45 μm) | Green density compacted at 5t/cm2 (Mg/m3) | Sintered body strength Sintered body density 6.8 Mg/m3 (MPa) |
|---|---|---|---|---|---|---|
| Example 2 | 81 | 75 | 35 | 25 | 6.94 | 400 |
| Example 3 | 155 | 75 | 32 | 30 | 6.8 | 390 |
| Example 4 | 196 | 75 | 32 | 31 | 6.72 | 380 |
| Example 5 | 245 | 75 | 33 | 32 | 6.7 | 360 |
| Example 6 | 240 | 75 | 30 | 30 | 6.71 | 370 |
| Example 7 | 248 | 75 | 30 | 30 | 6.7 | 390 |
| Example 8 | 247 | 75 | 28 | 33 | 6.75 | 380 |
| Example 9 | 230 | 75 | 29 | 33 | 6.72 | 360 |
| Example 10 | 100 | 40 | 43 | 25 | 7 | 350 |
| Example 11 | 101 | 150 | 29 | 36 | 6.76 | 390 |
| Example 12 | 110 | 200 | 15 | 41 | 6.72 | 400 |
| Comparative Example 2 | 315 | 75 | 30 | 30 | 6.5 | 400 |
| Comparative Example 3 | 290 | 75 | 32 | 31 | 6.61 | 380 |
| Comparative Example 4 | 305 | 75 | 31 | 30 | 6.57 | 390 |
| Comparative Example 5 | 283 | 75 | 29 | 29 | 6.58 | 370 |
| Comparative Example 6 | 295 | 30 | 43 | 10 | 6.52 | 300 |
| Comparative Example 7 | 260 | 75 | 29 | 21 | 6.59 | 300 |
| Comparative Example 8 | 150 | 250 | 5 | 45 | 6.6 | 390 |
| Comparative Example 9 | 155 | 30 | 43 | 10 | 6.53 | 290 |

Examples 12–24, Comparative Examples 10–19

After having been refined in a converter or an electric furnace, molten metal containing C: 0.002–0.03 wt %, Mn: 0.4 wt % or less, Ni: 0.4 wt % or less, Cr: 0.4 wt % or less, Si: 0.005–0.03 wt %, P: 0.002–0.025 wt %, S: 0.002–0.03 wt %, Mo: 6.0 wt % or less, Nb: 0.3 wt % or less was prepared by use of a vacuum degassing apparatus. This molten metal was atomized with water under a water pressure of 30–250 kgf/cm$^2$ and a water-to-molten-steel ratio of 10. The thus obtained powder was dried at 125° C. in a $N_2$ atmosphere, except in Comparative Example 19. Comparative Example

TABLE 3-1

| | Chemical composition of raw powder (wt %) | | | | | | | | | |
|---|---|---|---|---|---|---|---|---|---|---|
| | C | Mn | Ni | Cr | Si | P | S | Mo | Nb | O |
| Example 12 | 0.003 | 0.03 | 0.005 | 0.01 | 0.006 | 0.008 | 0.006 | 0.5 | 0.005 | 0.51 |
| Example 13 | 0.004 | 0.04 | 0.01 | 0001 | 0.006 | 0.01 | 0.005 | 1.0 | 0.007 | 0.45 |
| Example 14 | 0.005 | 0.03 | 0.01 | 0.011 | 0.007 | 0.008 | 0.006 | 2.0 | 0.006 | 0.52 |
| Example 15 | 0.003 | 0.05 | 0.008 | 0.012 | 0.008 | 0.008 | 0.006 | 4.0 | 0.006 | 0.44 |
| Example 16 | 0.002 | 0.05 | 0.007 | 0.004 | 0.01 | 0.009 | 0.008 | 0.5 | 0.01 | 0.5 |
| Example 17 | 0.002 | 0.04 | 0.011 | 0.006 | 0.006 | 0.008 | 0.006 | 0.5 | 0.05 | 0.42 |
| Example 18 | 0.002 | 0.04 | 0.008 | 0.008 | 0.006 | 0.008 | 0.006 | 0.5 | 0.05 | 0.42 |
| Example 19 | 0.002 | 0.04 | 0.011 | 0.006 | 0.006 | 0.008 | 0.006 | 0.2 | 0.15 | 0.42 |
| Example 20 | 0.006 | 0.01 | 0.01 | 0.005 | 0.02 | 0.01 | 0.015 | 0.3 | 0.02 | 0.35 |
| Example 21 | 0.01 | 0.02 | 0.005 | 0.005 | 0.008 | 0.007 | 0.002 | 0.2 | 0.02 | 0.5 |
| Example 22 | 0.003 | 0.25 | 0.006 | 0.005 | 0.008 | 0.008 | 0.006 | 0.1 | 0.03 | 0.5 |
| Example 23 | 0.002 | 0.03 | 0.25 | 0.005 | 0.008 | 0.007 | 0.006 | 0.2 | 0.008 | 0.47 |
| Example 24 | 0.002 | 0.03 | 0.012 | 0.25 | 0.008 | 0.007 | 0.006 | 0.5 | 0.009 | 0.53 |
| Comparative Example 10 | 0.03 | 0.04 | 0.011 | 0.006 | 0.006 | 0.008 | 0.006 | 0.2 | 0.15 | 0.42 |
| Comparative Example 11 | 0.002 | 0.4 | 0.008 | 0.01 | 0.01 | 0.01 | 0.009 | 0.2 | 0.007 | 0.5 |
| Comparative Example 12 | 0.005 | 0.1 | 0.4 | 0.01 | 0.01 | 0.008 | 0.009 | 0.5 | 0.007 | 0.56 |
| Comparative Example 13 | 0.004 | 0.06 | 0.01 | 0.4 | 0.01 | 0.008 | 0.009 | 0.5 | 0.007 | 0.55 |
| Comparative Example 14 | 0.003 | 0.11 | 0.01 | 0.009 | 0.01 | 0.025 | 0.03 | 0.5 | 0.008 | 0.61 |
| Comparative Example 15 | 0.003 | 0.1 | 0.01 | 0.011 | 0.008 | 0.007 | 0.008 | 6.0 | 0.01 | 0.57 |
| Comparative Example 16 | 0.003 | 0.1 | 0.01 | 0.01 | 0.007 | 0.011 | 0.007 | 0.4 | 0.3 | 0.59 |
| Comparative Example 17 | 0.005 | 0.02 | 0.005 | 0.005 | 0.008 | 0.007 | 0.002 | 0.2 | 0.02 | 0.5 |
| Comparative Example 18 | 0.005 | 0.02 | 0.005 | 0.005 | 0.008 | 0.007 | 0.002 | 0.2 | 0.02 | 0.5 |
| Comparative Example 19 | 0.002 | 0.11 | 0.011 | 0.009 | 0.01 | 0.011 | 0.008 | 0.1 | 0.008 | 1.5 |

TABLE 3-2

| | Powder hardness (Hv(100)) | Pressure of atomizing water (kgf/cm2) | Number % of Particles having coefficient of configuration of 2.5 or less (Particles size 75~106 μm) | wt % of Particle through 325 mesh (−45 μm) | Green density at 5t/cm2 (Mg/m3) | Sintered body strength Sintered body density 6.8 Mg/m3 (MPa) |
|---|---|---|---|---|---|---|
| Example 12 | 121 | 120 | 35 | 27 | 6.87 | 550 |
| Example 13 | 125 | 120 | 33 | 30 | 6.9 | 610 |
| Example 14 | 127 | 120 | 35 | 32 | 6.91 | 750 |
| Example 15 | 130 | 120 | 37 | 32 | 6.92 | 820 |
| Example 16 | 128 | 120 | 30 | 31 | 6.89 | 555 |
| Example 17 | 125 | 120 | 30 | 30 | 6.88 | 550 |
| Example 18 | 170 | 150 | 28 | 33 | 6.85 | 590 |
| Example 19 | 175 | 150 | 29 | 35 | 6.88 | 510 |
| Example 20 | 180 | 150 | 28 | 32 | 6.8 | 530 |
| Example 21 | 220 | 100 | 30 | 36 | 6.75 | 515 |
| Example 22 | 177 | 100 | 25 | 35 | 6.78 | 480 |
| Example 23 | 180 | 200 | 10 | 45 | 6.77 | 500 |
| Example 24 | 164 | 40 | 72 | 20 | 6.8 | 540 |
| Comparative ex. 10 | 310 | 120 | 30 | 30 | 6.5 | 505 |
| Comparative ex. 11 | 280 | 120 | 32 | 31 | 6.55 | 500 |
| Comparative ex. 12 | 270 | 120 | 31 | 31 | 6.53 | 540 |
| Comparative ex. 13 | 285 | 120 | 29 | 32 | 6.61 | 545 |
| Comparative ex. 14 | 288 | 120 | 28 | 30 | 6.6 | 550 |
| Comparative ex. 15 | 268 | 120 | 30 | 28 | 6.52 | 830 |
| Comparative ex. 16 | 280 | 120 | 29 | 25 | 6.51 | 530 |
| Comparative ex. 17 | 125 | 250 | 5 | 55 | 6.65 | 510 |
| Comparative ex. 18 | 130 | 30 | 80 | 10 | 6.89 | 250 |
| Comparative ex. 19 | 135 | 120 | 29 | 21 | 6.92 | 280 |

Examples 25–29, Comparative Examples 20–22

After having been refined in a converter or an electric furnace, molten metal containing C: 0.01 wt % or less, Mn: 0.1 wt % or less, Ni: 0.1 wt % or less, Cr: 0.1 wt % or less, Si: 0.02 wt % or less, P: 0.02 wt % or less, S: 0.02 wt % or less, Al: 0.1 wt % or less was prepared by use of a vacuum degassing apparatus. This molten metal was atomized with water under water pressure of 120 kgf/cm$^2$ and a water-to-molten-steel ratio of 10. The thus obtained raw powders were dried at 125° C. in an $N_2$ atmosphere. The raw powders were screened to 250 μm or less without being annealed or reduced. Table 4 shows particle hardness, chemical composition of iron powders, green density, rattler value, tensile strength, and impact value. Examples 25–29 have an oxygen content of 0.4% or less because it contains a proper amount of Al. As a result, these examples exhibit a green density of 6.7 g/m$^3$ or more, sintered body strength of 40 kgf/mm$^2$ or more and rattler value of 1.5% or less, but Comparative Examples 20, 22 exhibit a rattler value of 1.5% or more and a lowered formability because they contain Al in an amount exceeding a proper range although having a green density of 6.7 g/m$^3$ or more. Further, Comparative Example 21 has a green density of 6.5 g/m$^3$ or less because it has a hardness exceeding Hv 250.

TABLE 4

| | Chemical composition of iron powder (wt %) | | | | | Green | Rattler | | |
|---|---|---|---|---|---|---|---|---|---|
| | Al (%) | C (%) | O (%) | Fe and other indispensable impurities | Hardness Hv (100 g) | density (g/cm3) | value (%) | Tensile strength (kg/mm2) | Impact value (kg-m/cm2) |
| Example 25 | 0.006 | 0.003 | 0.38 | the remainder | 120 | 6.70 | 0.85 | 42 | 0.9 |
| Example 26 | 0.010 | 0.004 | 0.36 | the remainder | 124 | 6.75 | 0.9 | 43 | 0.95 |
| Example 27 | 0.021 | 0.003 | 0.35 | the remainder | 130 | 6.74 | 1.0 | 44 | 0.88 |
| Example 28 | 0.031 | 0.002 | 0.33 | the remainder | 133 | 6.80 | 1.2 | 43 | 0.87 |
| Example 29 | 0.046 | 0.002 | 0.30 | the remainder | 135 | 6.81 | 1.4 | 41 | 0.85 |
| Comparative Example 20 | 0.001 | 0.003 | 0.55 | the remainder | 135 | 6.71 | 1.9 | 40 | 0.83 |
| Comparative Example 21 | 0.020 | 0.025 | 0.34 | the remainder | 270 | 6.45 | 3.8 | 32 | 0.65 |
| Comparative Example 22 | 0.070 | 0.002 | 0.30 | the remainder | 140 | 6.80 | 1.5 | 31 | 0.63 |

Examples 30–36, Comparative Examples 23–26

After having been refined in a converter or an electric furnace, molten metal containing C: 0.01 wt % or less, Mn: 0.1 wt % or less, Ni: 0.1 wt % or less, Cr: 0.1 wt % or less, Si: 0.02 wt % or less, P: 0.02 wt % or less, S: 0.02 wt % or less, Si+Ti+Zr: 0.2 wt % or less was prepared by use of a vacuum degassing apparatus. This molten metal was atomized at a water pressure of 130 kgf/cm$^2$. The thus obtained raw powders were dried at 125° C. in an Ns atmosphere. The raw powders were screened to 250 μm or less without being annealed or reduced.

Table 5 shows particle hardness, chemical composition of iron powders, green density, rattler value, tensile strength and impact value.

Examples 30–36 have an oxygen content of 0.5% or less because they contain a proper amount of any of Si, Ti or Zr. As a result, these Examples exhibit a sintered body strength of 40 kgf/mm$^2$ or more and rattler value of 1.5% or less, but Comparative Examples 23 exhibits a rattler value of 1.5% or more and a lowered formability because it contains Si, Ti, Zr in an amount less than the proper range. Comparative Example 24 has a green density of 6.5 g/m$^3$ or less because it has a particle hardness exceeding Hv 250. Further, Comparative Examples 25 and 26, which contain Si, Ti, Zr in an amount exceeding a proper range, have a lowered sintered body strength.

TABLE 5-1

| | Composition value of molten steel (wt %) | | | | | Atomizing conditions Atomizing Pressure 130 kgf/cm2 | | Analyzed value of atomized raw powder (wt %) | | | | |
|---|---|---|---|---|---|---|---|---|---|---|---|---|
| | Si (%) | Ti (%) | Zr (%) | C (%) | O (%) | Water to molten steel ratio δ | Atmosphere (O2 concentration) | Si (%) | Ti (%) | Zr (%) | C (%) | O (%) |
| Example 30 | 0.020 | 0.002 | 0.002 | 0.008 | 0.010 | 8 | N2(1.0) | 0.020 | 0.002 | 0.002 | 0.002 | 0.38 |
| Example 31 | 0.013 | 0.002 | 0.002 | 0.009 | 0.007 | 7.5 | N2(1.0) | 0.012 | 0.002 | 0.002 | 0.003 | 0.45 |
| Example 32 | 0.032 | 0.002 | 0.003 | 0.010 | 0.005 | 7 | N2(0.5) | 0.030 | 0.002 | 0.003 | 0.004 | 0.33 |
| Example 33 | 0.004 | 0.020 | 0.022 | 0.008 | 0.009 | 7 | N2(1.0) | 0.004 | 0.020 | 0.020 | 0.002 | 0.35 |
| Example 34 | 0.004 | 0.016 | 0.015 | 0.007 | 0.006 | 7.5 | N2(0.5) | 0.004 | 0.015 | 0.015 | 0.002 | 0.40 |
| Example 35 | 0.001 | 0.002 | 0.018 | 0.005 | 0.007 | 7 | Ar(0.3) | 0.001 | 0.002 | 0.017 | 0.003 | 0.45 |
| Example 36 | 0.021 | 0.021 | 0.015 | 0.006 | 0.005 | 6.5 | N2(2.0) | 0.020 | 0.020 | 0.015 | 0.003 | 0.40 |
| Comparative ex. 23 | 0.003 | <0.001 | <0.001 | 0.005 | 0.020 | 7 | N2(2.0) | 0.002 | <0.001 | <0.001 | 0.003 | 0.60 |
| Comparative ex. 24 | 0.015 | 0.010 | 0.002 | 0.035 | 0.007 | 7 | N2(1.0) | 0.015 | 0.010 | 0.002 | 0.020 | 0.40 |
| Comparative ex. 25 | 0.121 | 0.010 | 0.005 | 0.007 | 0.007 | 8 | N2(1.0) | 0.120 | 0.010 | 0.005 | 0.003 | 0.35 |
| Comparative ex. 26 | 0.055 | 0.150 | 0.033 | 0.007 | 0.005 | 7.5 | N2(1.0) | 0.050 | 0.030 | 0.030 | 0.002 | 0.38 |

TABLE 5-2

| | Hardness HV (100 g) | Characteristic of green compact: Green density (g/cm3) | Rattler value (%) | Characteristic of sinterd body: Tensile strength (kg/mm2) | Impact value (kg-m/cm2) |
|---|---|---|---|---|---|
| Example 30 | 130 | 6.72 | 0.8 | 44 | 0.95 |
| Example 31 | 125 | 6.75 | 0.9 | 42 | 0.92 |
| Example 32 | 130 | 6.76 | 1.0 | 45 | 0.88 |
| Example 33 | 130 | 6.82 | 1.1 | 43 | 0.87 |
| Example 34 | 128 | 6.80 | 1.3 | 41 | 0.85 |
| Example 35 | 135 | 6.71 | 1.2 | 40 | 0.8 |
| Example 36 | 138 | 6.60 | 0.9 | 42 | 0.85 |
| Comparative Example 23 | 135 | 6.70 | 2.0 | 39 | 0.75 |
| Comparative Example 24 | 270 | 6.45 | 3.8 | 31 | 0.6 |
| Comparative Example 25 | 150 | 6.60 | 1.4 | 29 | 0.5 |
| Comparative Example 26 | 145 | 6.63 | 1.4 | 30 | 0.55 |

Examples 37, Comparative Example 27

Molten metal containing C: 0.004 wt %, Mn: 0.03 wt %, Ni: 0.005 wt %, Cr: 0.01 wt %, Si: 0.006 wt %, P: 0.008 wt %, S: 0.006 wt %, Al: 0.004 wt % was prepared in such a manner that molten steel was refined in a converter and decarbonized by use of a vacuum decarbonizing apparatus. This molten metal was atomized with jet water having a water pressure of 70 kgf/cm$^2$ in an $N_2$ atmosphere having an oxygen concentration of 0.5%. The thus obtained powder was dried at 180° C. in a $H_2$ atmosphere and then screened to 250 μm or less without being annealed and reduced.

Green density was measured in such a manner that 1.0 wt % of zinc stearate was added to and mixed with raw powder and a tablet having a diameter of 11.3 mmϕ was compacted at a pressure of 5 t/cm$^2$. Sintered body strength was measured in such a manner that powder prepared by mixing raw iron powder, Cu powder, graphite powder and zinc stearate as lubricant was compacted to a JSPM standard tensile strength test piece and the tensile strength of a sintered body (sintered density: 6.8 Mg/m$^3$, a composition of Fe-2.0 Cu-0.8 C) obtained by sintering the test piece at 1130° in an endothermic gas (propane converted gas) atmosphere for 20 minutes was measured. A dimensional change in sintering was examined with respect to amounts of graphite of two levels or Fe-2.0% Cu-0.8% Gr and Fe-2.0% Cu-1.0% Gr and a difference of the respective changes of sintered dimension was used as a "variable range of dimensional changes". At that time, the test piece was formed to a ring shape with an outside diameter of 60ϕ, inside diameter of 25ϕ, height of 10 mm, and green density of 6.85 g/cm$^3$ and sintered at 1130° C. in an endothermic gas (propane converted gas) atmosphere for 20 minutes.

Comparative Example 27 was obtained by subjecting commercially available water-atomized iron powder for powder metallurgy which had been reduced and annealed to the same process as the aforesaid one. Table 6-1 shows a chemical composition of iron powders and a ratio of oxidization of easy-to-oxidize elements, and Table 6-2 shows a hardness of particle cross section, green density, sintered body strength and variable range of dimensional changes. Example 37 not only has substantially the same green density as that of Comparative Example 27 but also exhibits a variable range of dimensional changes superior to that of the iron powder of Comparative Example 27 regardless of that Example 37 is not annealed and reduced.

TABLE 6-1

| | Chemical composition of raw powder (wt %): C | Mn | Ni | Cr | Si | P | S | Al | O | Ratio of oxidization of easy-to-oxidize elements (%) |
|---|---|---|---|---|---|---|---|---|---|---|
| Example 37 | 0.004 | 0.03 | 0.005 | 0.01 | 0.006 | 0.008 | 0.006 | 0.004 | 0.45 | 35 |
| Comparative Example 27 | 0.001 | 0.11 | 0.011 | 0.009 | 0.01 | 0.012 | 0.009 | — | 0.1 | — |

TABLE 6-2

| | Green density compacted at 5t/cm2 (Mg/m3) | Sintered body strength Sintered body density 6.8 Mg/m3 (MPa) | Variable range of dimentional changes (%) | Hardness (%) |
|---|---|---|---|---|
| Example 37 | 6.86 | 440 | 0.06 | 110 |
| Comparative Example 27 | 6.91 | 430 | 0.2 | 100 |

Examples 38–52, Comparative Examples 28–31

After having been refined in a converter or an electric furnace, molten metal containing C: 0.01 wt % or less, Mn: 0.1 wt % or less, Ni: 0.1 wt % or less, Cr: 0.1 wt % or less, P: 0.02 wt % or less, S: 0.02 wt % or less, a total amount of Si, Al, Ti and V: 0.6 wt % or less was prepared by use of a vacuum degassing apparatus. This molten metal was atomized with water having a pressure of 100 kgf/cm$^2$ in an $N_2$ atmosphere with an oxygen concentration of 10% or less.

The thus obtained raw powders were dried at 100°–300° C. in $H_2$, $N_2$ or vacuum for 60 minutes and then screened to 250 μm or less without being-annealed and reduced.

Green density, sintered body strength and variable range of dimensional changes of sintered body were measured by the same methods as those of Example 37. Table 7 shows the a chemical composition of iron powders, ratio of oxygen in easy-to-oxidize elements, hardness of particle cross-section, sintered body strength and variable range of dimensional changes of Examples 38–52 and Comparative Examples 28–31.

Any of Examples 38–52 exhibit a practically applicable green density and sintered body strength. Further, they exhibit an excellent dimensional accuracy with a variable range of dimensional changes of 0.1% or less.

With Example 51, where a small amount of easy-to-oxidize elements is contained, and Example 52, where a ratio of oxidization of easy-to-oxidize elements is 20 wt % or less, although dimensional accuracy was lowered, practically useful green density and sintered body strength were obtained.

Because a total amount of Si, Al, Ti and V in Comparative Examples 28 to 31 exceeds the upper limit of a proper range, only a low sintered body strength was obtained.

TABLE 7

| | Atomizing atmosphere O2 concentration | Drying condition (%) | Chemical composition of iron powder Si (%) | Al (%) | Ti (%) | V (%) | O (%) | Ratio of oxidization of easy-to-oxidize elements (%) | Powder hardness (HV (100)) | Green density (g/cm3) | Tensile strength (kg/mm2) | Variable range (%) |
|---|---|---|---|---|---|---|---|---|---|---|---|---|
| Example 38 | 0.5 | 150° C. H2 | 0.01 | <0.001 | <0.001 | <0.001 | 0.30 | 35 | 115 | 6.91 | 40 | 0.10 |
| Example 39 | 0.5 | 150° C. H2 | 0.05 | <0.001 | <0.001 | <0.001 | 0.32 | 29 | 115 | 6.93 | 40 | 0.09 |
| Example 40 | 0.5 | 150° C. H2 | 0.10 | <0.001 | <0.001 | <0.001 | 0.32 | 31 | 120 | 6.91 | 41 | 0.09 |
| Example 41 | 0.5 | 200° C. H2 | 0.002 | 0.004 | <0.001 | <0.001 | 0.26 | 39 | 130 | 6.28 | 40 | 0.09 |
| Example 42 | 0.5 | 250° C. H2 | 0.008 | 0.004 | <0.001 | <0.001 | 0.30 | 35 | 128 | 6.89 | 45 | 0.10 |
| Example 43 | 0.1 | 150° C. N2 | 0.002 | 0.010 | <0.001 | <0.001 | 0.30 | 40 | 135 | 6.85 | 44 | 0.08 |
| Example 44 | 1 | 150° C. vacuum | 0.002 | 0.05 | <0.001 | <0.001 | 0.31 | 24 | 139 | 6.82 | 40 | 0.06 |
| Example 45 | 2 | 150° C. H2 | 0.002 | <0.001 | 0.005 | <0.001 | 0.35 | 26 | 135 | 6.9 | 42 | 0.05 |
| Example 46 | 1 | 150° C. H2 | 0.002 | <0.001 | 0.10 | <0.001 | 0.33 | 32 | 130 | 6.91 | 41 | 0.07 |
| Example 47 | 0.2 | 150° C. N2 | 0.002 | <0.001 | <0.001 | 0.01 | 0.35 | 34 | 135 | 6.89 | 42 | 0.08 |
| Example 48 | 0.3 | 150° C. N2 | 0.002 | <0.001 | <0.001 | 0.40 | 0.32 | 28 | 135 | 6.9 | 41 | 0.07 |
| Example 49 | 0.5 | 180° C. H2 | 0.010 | <0.001 | <0.001 | 0.10 | 0.32 | 35 | 130 | 6.89 | 40 | 0.09 |
| Example 50 | 0.5 | 180° C. H2 | 0.002 | 0.003 | 0.003 | 0.05 | 0.32 | 31 | 120 | 6.91 | 41 | 0.10 |
| Example 51 | 0.5 | 180° C. H2 | 0.002 | <0.001 | <0.001 | <0.001 | 0.80 | 50 | 150 | 6.78 | 40 | 0.21 |
| Example 52 | 6 | 180° C. H2 | 0.005 | 0.005 | <0.001 | 0.01 | 0.85 | 15 | 220 | 6.75 | 41 | 0.20 |
| Comparative Example 28 | 0.3 | 150° C. N2 | 0.20 | 0.001 | 0.001 | 0.001 | 0.56 | 22 | 210 | 6.77 | 32 | 0.12 |
| Comparative Example 29 | 0.03 | 150° C. N2 | 0.005 | 0.10 | 0.001 | 0.001 | 0.58 | 20 | 180 | 6.74 | 33 | 0.11 |
| Comparative Example 30 | 0.3 | 150° C. N2 | 0.005 | 0.003 | 0.20 | 0.01 | 0.52 | 22 | 190 | 6.76 | 31 | 0.10 |
| Comparative Example 31 | 0.3 | 150° C. N2 | 0.005 | 0.003 | 0.40 | 0.60 | 0.55 | 22 | 190 | 6.72 | 31 | 0.12 |

Examples 53–68, Comparative Examples 32–38

After having been refined in a converter or an electric furnace, molten metal containing C: 0.02 wt % or less, a content of each of Mn, Ni, Cr: 0.3 wt % or less, P: 0.002–0.02 wt %, S: 0.002–0.02 wt %, Mo: 6.0 wt % or less, Nb: 0.3 wt % or less, a total content of Si, V, Al, Ti and Zr: 1.5 wt % or less was prepared by use of a vacuum degassing apparatus. This molten metal was atomized with water having a pressure of 80–160 kgf/cm$^2$ in an atmosphere with an oxygen ($O_2$) concentration of 10 vol % or less and then dried at 100°–300° C. in hydrogen, nitrogen or vacuum. The raw powders were screened to 250 μm or less without being annealed or reduced.

Green density, sintered body strength and variable range of dimensional changes of sintered body were measured by the same methods as those of Example 37.

Table 8-1 shows chemical compositions of iron powders of Examples 53–68 and Comparative Examples 32–38, and Table 8-2 shows atomizing conditions, drying conditions, ratios of oxidation of the easy-to-oxidize elements, powder hardness, ratios of the particles having a coefficient of configuration of 2.5 or less in the particles having a particle size of 75–106 μm or less, ratio of the particles having a particle size of –325 mesh (45 μm or less), and green density without finishing reduction, sintered body density and variable range of dimensional changes of these examples and comparative examples.

All of Examples 53–68 exhibit practically applicable green density and sintered body strength. Further, Examples 53–66 exhibit excellent dimensional accuracy with a variable range of dimensional changes of 0.1% or less.

With Example 67, where a ratio of oxidization of easy-to-oxidize elements is 20 wt % or less, and Example 68, where a small amount of easy-to-oxidize elements is contained, although dimensional accuracy was lowered, practically useful green density and sintered body strength were obtained.

Because a total amount of Si, Al, Ti and V in Comparative Examples 28 to 31 exceeds the upper limit of a proper range, only a low sintered body strength was obtained.

On the other hand, Comparative Examples 32–38 have a low green density or low sintered body strength because proper ranges of the present invention were exceeded.

The iron powder for powder metallurgy according to the present invention does not need an annealing step or a reducing process after the iron powder has been atomizod with water, as has been needed for conventional water-atomized iron powder, so that the iron powder can be compacted in dies as a raw powder. Further, when the iron powder according to the present invention is sintered with the addition of Cu, graphite, the dimensional changes thereof caused in the sintering are less varied with respect to the dispersion of added graphite as compared with conventional iron powder for powder metallurgy. As a result, a sintered body having excellent dimensional accuracy can be made, even allowing a sizing process to be omitted. Consequently, manufacturing of sintered parts can be simplified and shortened when the iron powder according to the present invention is used. Further, manufacturing cost of sintered parts can be decreased without damaging the characteristics of the product.

TABLE 8-1

| | Chemical composition of raw powder (wt %) | | | | | | | | | | | | | |
|---|---|---|---|---|---|---|---|---|---|---|---|---|---|---|
| | C | Mn | Ni | Cr | P | S | Mo | Nb | Si | V | Al | Ti | Zr | O |
| Example 53 | 0.003 | 0.01 | 0.005 | 0.01 | 0.003 | 0.006 | 0.01 | 0.005 | 0.005 | <0.001 | 0.004 | <0.001 | <0.001 | 0.3 |
| Example 54 | 0.004 | 0.04 | 0.01 | 0.01 | 0.01 | 0.005 | 0.5 | 0.007 | 0.005 | <0.001 | 0.006 | <0.001 | <0.001 | 0.35 |
| Example 55 | 0.005 | 0.03 | 0.01 | 0.011 | 0.008 | 0.006 | 1.0 | 0.006 | 0.004 | <0.001 | 0.02 | <0.001 | <0.001 | 0.45 |
| Example 56 | 0.001 | 0.2 | 0.008 | 0.012 | 0.008 | 0.006 | 2.0 | 0.006 | 0.006 | <0.001 | 0.05 | <0.001 | <0.001 | 0.44 |
| Example 57 | 0.002 | 0.1 | 0.007 | 0.004 | 0.009 | 0.008 | 4.0 | 0.01 | 0.008 | <0.001 | 0.001 | <0.001 | <0.001 | 0.5 |
| Example 58 | 0.002 | 0.04 | 0.3 | 0.006 | 0.004 | 0.006 | 0.5 | 0.05 | 0.05 | 0.01 | 0.006 | <0.001 | <0.001 | 0.42 |
| Example 59 | <0.001 | 0.04 | 0.008 | 0.008 | 0.008 | 0.003 | 0.5 | 0.05 | 0.1 | <0.001 | 0.002 | <0.001 | <0.001 | 0.42 |
| Example 60 | 0.002 | 0.04 | 0.011 | 0.006 | 0.02 | 0.006 | 0.2 | 0.15 | 0.006 | 0.05 | 0.006 | <0.001 | <0.001 | 0.42 |
| Example 61 | 0.006 | 0.01 | 0.01 | 0.005 | 0.01 | 0.015 | 0.3 | 0.2 | 0.008 | 0.15 | <0.001 | <0.001 | <0.001 | 0.33 |
| Example 62 | 0.009 | 0.02 | 0.005 | 0.006 | 0.007 | 0.002 | 0.2 | 0.02 | 0.008 | 0.45 | <0.001 | <0.001 | <0.001 | 0.33 |
| Example 63 | 0.003 | 0.3 | 0.006 | 0.005 | 0.008 | 0.006 | 0.1 | 0.03 | 0.005 | 0.01 | 0.003 | 0.01 | <0.001 | 0.3 |
| Example 64 | 0.002 | 0.03 | 0.3 | 0.005 | 0.007 | 0.006 | 0.2 | 0.008 | 0.005 | 0.01 | 0.008 | 0.1 | <0.001 | 0.28 |
| Example 65 | 0.002 | 0.03 | 0.012 | 0.3 | 0.007 | 0.006 | 0.5 | 0.009 | 0.009 | 0.01 | 0.004 | <0.001 | 0.01 | 0.44 |
| Example 66 | 0.001 | 0.1 | 0.01 | 0.01 | 0.006 | 0.007 | 1.0 | 0.01 | 0.007 | 0.007 | 0.003 | <0.001 | 0.1 | 0.45 |
| Example 67 | 0.002 | 0.05 | 0.01 | 0.01 | 0.007 | 0.007 | 0.2 | 0.05 | 0.007 | 0.007 | 0.005 | 0.01 | 0.01 | 0.53 |
| Example 68 | 0.003 | 0.04 | 0.011 | 0.006 | 0.008 | 0.006 | 0.5 | 0.01 | 0.002 | <0.001 | <0.001 | <0.001 | <0.001 | 0.84 |
| Comparative ex. 32 | 0.022 | 0.09 | 0.008 | 0.01 | 0.01 | 0.009 | 0.2 | 0.007 | 0.002 | 0.007 | 0.01 | <0.001 | <0.001 | 0.42 |
| Comparative ex. 33 | 0.003 | 0.1 | 0.01 | 0.011 | 0.007 | 0.008 | 1.0 | 0.01 | 0.2 | 0.009 | 0.002 | <0.001 | <0.001 | 1.1 |
| Comparative ex. 34 | 0.003 | 0.1 | 0.01 | 0.01 | 0.011 | 0.007 | 0.4 | 0.3 | 0.01 | 0.6 | 0.007 | <0.001 | <0.001 | 0.59 |
| Comparative ex. 35 | 0.004 | 0.1 | 0.01 | 0.01 | 0.01 | 0.007 | 2.0 | 0.01 | 0.01 | 0.009 | 0.07 | <0.001 | <0.001 | 0.58 |
| Comparative ex. 36 | 0.005 | 0.02 | 0.005 | 0.005 | 0.007 | 0.002 | 0.2 | 0.02 | 0.02 | 0.015 | 0.008 | 0.2 | 0.005 | 0.5 |
| Comparative ex. 37 | 0.005 | 0.02 | 0.005 | 0.005 | 0.007 | 0.002 | 0.2 | 0.02 | 0.02 | 0.015 | 0.008 | 0.002 | 0.2 | 0.5 |
| Comparative ex. 38 | 0.002 | 0.11 | 0.011 | 0.009 | 0.011 | 0.008 | 0.1 | 0.008 | 0.008 | 0.01 | 0.01 | <0.001 | <0.001 | 1.5 |

TABLE 8-2

| | Atomizing conditions | | | Ratio of | | | wt % of |
|---|---|---|---|---|---|---|---|
| | Atomizing atmosphere O2 concentration (%) | Atomizing pressure (kgf/cm2) | Drying conditions Gas Temperature | oxidization of easy-to-oxidize elements (%) | Powder hardness (Hv (100)) | Number % of Particles having coefficient of configuration of 2.5 or less (Particle size 75~106 μm) | Particles through 3 25 mesh (~45 μm) |
| Example 53 | 0.5 | 100 | H2-180° C. | 35 | 115 | 35 | 30 |
| Example 54 | 0.5 | 100 | H2-180° C. | 34 | 120 | 40 | 28 |
| Example 55 | 0.5 | 100 | H2-180° C. | 25 | 125 | 35 | 33 |
| Example 56 | 0.5 | 100 | H2-180° C. | 28 | 130 | 35 | 32 |
| Example 57 | 0.5 | 100 | H2-130° C. | 30 | 137 | 38 | 33 |
| Example 58 | 1 | 120 | H2-180° C. | 45 | 138 | 30 | 35 |
| Example 59 | 1 | 120 | N2-150° C. | 49 | 140 | 32 | 35 |
| Example 60 | 1 | 120 | N2-150° C. | 35 | 135 | 28 | 36 |
| Example 61 | 1 | 120 | N2-150° C. | 50 | 150 | 30 | 34 |
| Example 62 | 2 | 80 | Vac.-150° C. | 33 | 175 | 45 | 22 |
| Example 63 | 2 | 80 | H2-280° C. | 38 | 135 | 42 | 23 |
| Example 64 | 0.2 | 160 | H2-280° C. | 25 | 130 | 25 | 40 |
| Example 65 | 0.2 | 160 | H2-280° C. | 35 | 120 | 26 | 43 |
| Example 66 | 0.2 | 130 | N2-150° C. | 36 | 110 | 28 | 40 |
| Example 67 | 5 | 130 | N2-150° C. | 15 | 125 | 28 | 38 |
| Example 68 | 0.5 | 120 | H2-180° C. | — | 130 | 25 | 35 |
| Comparative ex. 32 | 0.5 | 80 | H2-180° C. | 38 | 280 | 45 | 22 |
| Comparative ex. 33 | 0.5 | 80 | N2-180° C. | 42 | 260 | 42 | 22 |
| Comparative ex. 34 | 0.5 | 100 | N2-180° C. | 38 | 270 | 35 | 20 |
| Comparative ex. 35 | 0.5 | 100 | N2-180° C. | 40 | 280 | 36 | 21 |
| Comparative ex. 36 | 0.5 | 100 | N2-180° C. | 36 | 270 | 38 | 23 |

TABLE 8-2-continued

| | Atomizing conditions | | | Ratio of | | | wt % of |
|---|---|---|---|---|---|---|---|
| | Atomizing atmosphere O2 concentration (%) | Atomizing pressure (kgf/cm2) | Drying conditions Gas Temperature | oxidization of easy-to-oxidize elements (%) | Powder hardness (Hv (100)) | Number % of Particles having coefficient of configuration of 2.5 or less (Particle size 75~106 μm) | Particles through 3 25 mesh (~45 μm) |
| Comparative ex. 37 | 0.5 | 100 | N2-180° C. | 35 | 260 | 35 | 30 |
| Comparative ex. 38 | 8 | 100 | N2-180° C. | 18 | 190 | 35 | 28 |

TABLE 8-3

| | Green density compacted at 5t/cm2 (Mg/m3) | Sintered body strength Sintered body density 6.8 Mg/m3 (MPa) | Variable range of dimentional changes (%) |
|---|---|---|---|
| 53 | 6.85 | 420 | 0.06 |
| 54 | 6.87 | 560 | 0.05 |
| 55 | 6.89 | 615 | 0.07 |
| 56 | 6.91 | 735 | 0.07 |
| 57 | 6.83 | 820 | 0.07 |
| 58 | 6.82 | 550 | 0.06 |
| 59 | 6.8 | 545 | 0.07 |
| 60 | 6.9 | 595 | 0.05 |
| 61 | 6.82 | 605 | 0.05 |
| 62 | 6.79 | 500 | 0.09 |
| 63 | 6.86 | 510 | 0.05 |
| 64 | 6.87 | 515 | 0.07 |
| 65 | 6.88 | 555 | 0.08 |
| 66 | 6.89 | 605 | 0.07 |
| 67 | 6.88 | 520 | 0.15 |
| 68 | 6.8 | 520 | 0.14 |
| 32 | 6.67 | 410 | 0.1 |
| 33 | 6.68 | 380 | 0.09 |
| 34 | 6.65 | 375 | 0.1 |
| 35 | 6.66 | 350 | 0.1 |
| 36 | 6.68 | 395 | 0.1 |
| 37 | 6.68 | 355 | 0.1 |
| 38 | 6.69 | 390 | 0.2 |

What is claimed is:

1. Iron powder for powder metallurgy consisting essentially of a water atomized, non-heat treated iron powder containing C: 0.01 wt % or less, Mn: 0.30 wt % or less, Ni: 0.30 wt % or less, Cr: 0.30 wt % or less, Mo: about 5.0 wt % or less, Nb: about 0.20 wt % or less, a total of P and S: 0.05 wt % or less as impurities, at least one additional element that is more easily oxidizable than iron and wherein the balance is substantially Fe, wherein those of said particles having a particle size from about 75 μm to about 106 μm, include a portion having a coefficient of particle cross-sectional configuration of about 2.5 or less and are present in a numerical amount of about 10% or more, said powder including particles having a particle size of about 45 μm or less present in an amount of about 20 wt % or more, and having a particle cross section hardness of from about Hv 80 or higher to about 250 or lower, said powder further having a particle surface covered with at least one oxide which is reducible in a sintering atmosphere, and said surface having an oxygen content of about 1.0 wt % or less.

2. Iron powder further according to claim 1 wherein said additional element is present in a particle surface covered with oxide that is not reducible in the usual subsequent sintering atmosphere.

3. Iron powder according to claim 2, wherein said element more easily oxidizable than iron includes one or two or more elements selected from the group consisting of Si: 0.01–0.1 wt %, Al: 0.003–0.05 wt %, V: 0.008–0.5 wt %, Ti: 0.003–0.1 wt % and Zr: 0.008–0.1 wt %.

4. Iron powder according to claim 3, wherein said additional elements are present in a total amount of about 0.003 to 0.5 wt %.

5. Iron powder for powder metallurgy consisting essentially of a water-atomized, non-heat treated iron powder containing C: 0.01 wt % or less, Mn: 0.30 wt % or less, Ni: 0.30 wt % or less, Cr: 0.30 wt % or less, Mo: about 5.0 wt % or less, Nb: about 0.20 wt % or less, a total of P and S: 0.05 wt % or less as impurities, at least one additional element present in a particle surface covered with oxide which is not reducible in a sintering atmosphere, said additional element selected from the group consisting of Al: 0.003–0.05 wt %, V: 0.008–0.5 wt %, Ti: 0.003–0.1 wt % and Zr: 0.008–0.1 wt % that is more easily oxidizable than iron and wherein the balance is substantially Fe, wherein those of said particles having a particle size from about 75 μm to about 106 μm, include a portion having a coefficient of particle cross-sectional configuration of about 2.5 or less and the amount of said portion is about 10% or more in said particles, said powder including particles having a particle size of about 45 μm or less present in an amount of about 20 wt % or more, and having a particle cross section hardness of from about Hv 80 or higher to about 250 or lower, said powder further having a particle surface covered with at least one oxide which is reducible in a sintering atmosphere, and said surface having an oxygen content of about 1.0 wt % or less.

* * * * *

UNITED STATES PATENT AND TRADEMARK OFFICE

CERTIFICATE OF CORRECTION

PATENT NO. : 5,534,045

DATED : July 9, 1996

INVENTOR(S) : Kuniaki Ogura, Hiroyuki Ishikawa, Yoshiaki Maeda and Kouichi Komamura It is certified that error appears in the above-indentified patent and that said Letters Patent is hereby corrected as shown below:

In Column 1, line 51, please change "atomizod" to --atomized--.

In Column 8, line 8, please change "atomizod" to --atomized--.

In Column 13, line 27, please change "$N_3$" to --$N_2$--.

Signed and Sealed this

Tenth Day of December, 1996

Bruce Lehman

*Attest:*

BRUCE LEHMAN

*Attesting Officer*

*Commissioner of Patents and Trademarks*